United States Patent [19]

Bernard

[11] Patent Number: 5,004,184

[45] Date of Patent: Apr. 2, 1991

[54] SYSTEM OF VEHICLE GUIDANCE BY CONTINUOUS GAS JETS

[75] Inventor: Marc Bernard, Marcilly en Villette, France

[73] Assignee: Thomson-Brandt Armements, Boulogne Billancourt, France

[21] Appl. No.: 483,644

[22] Filed: Feb. 23, 1990

[30] Foreign Application Priority Data

Mar. 3, 1989 [FR] France ..... 89 02785

[51] Int. Cl.[5] ..... F42B 10/66

[52] U.S. Cl. ..... 244/3.22

[58] Field of Search ..... 244/3.22, 169

[56] References Cited

U.S. PATENT DOCUMENTS

| | | | |
|---|---|---|---|
| 3,249,325 | 5/1966 | Forehand | 244/3.22 |
| 3,446,436 | 5/1969 | Desjardins et al. | 239/265.25 |
| 3,599,899 | 8/1971 | McCullough | 244/3.22 |
| 4,017,040 | 4/1977 | Dillinger et al. | 244/3.22 |
| 4,384,690 | 5/1983 | Brodersen | 244/3.22 |
| 4,599,044 | 7/1986 | Jacobson | 417/42 |
| 4,852,827 | 8/1989 | Kranz | 244/3.22 |
| 4,913,379 | 4/1990 | Kubota et al. | 244/52 |

FOREIGN PATENT DOCUMENTS

| | | |
|---|---|---|
| 110774 | 6/1984 | European Pat. Off. . |
| 3108283 | 9/1982 | Fed. Rep. of Germany . |
| 3138869 | 4/1983 | Fed. Rep. of Germany . |
| 3429798 | 12/1985 | Fed. Rep. of Germany . |
| 2501359 | 9/1982 | France . |
| 2573861 | 5/1986 | France . |
| 2612289 | 9/1988 | France . |

*Primary Examiner*—Charles T. Jordan
*Assistant Examiner*—Richard W. Wendtland
*Attorney, Agent, or Firm*—Oblon, Spivak, McClelland, Maier & Neustadt

[57] ABSTRACT

A system of guidance in yaw, pitch and roll, which enables a small number of nozzles (three) to be used. Each of the nozzles supplies a continuous gas jet, which can be oriented about an axis substantially parallel to the axis of the vehicle which carries them, the deflection of each of the nozzles preferably being limited to ±60°.

5 Claims, 2 Drawing Sheets

SYSTEM OF VEHICLE GUIDANCE BY CONTINUOUS GAS JETS

Figure 1:
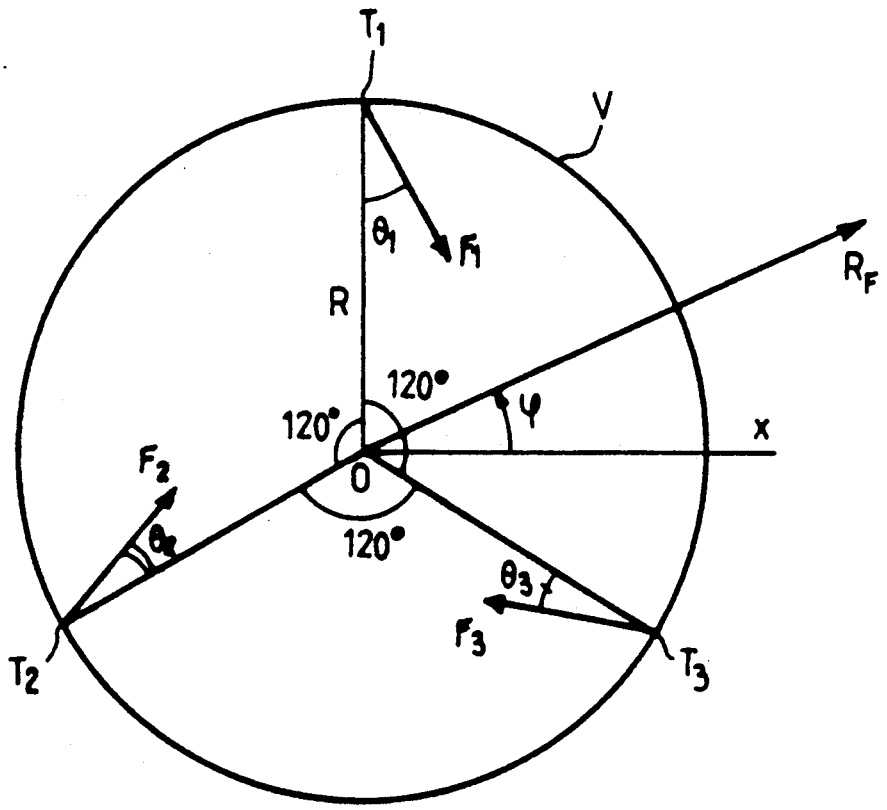

The object of the present invention is a vehicle guidance system using directional nozzles being fed continuously by a gas generator.

"Vehicle38 is here understood to mean any flying guided missile, whether propelled or not. Guidance is taken to mean, by extension, both guidance of the centre of gravity of the vehicle and piloting of the vehicle about its centre of gravity.

Different guidance systems, both aerodynamic and pyrotechnic, are already known.

The aerodynamic systems have various limitations owing notably to their complexity, their response time and their variability as a function of the velocity of the vehicle.

The pyrotechnic systems are of several types: discontinuous or continuous boosters, explosive bars, systems using switching of jets from several nozzles and finally systems using the orientation of the jet from the nozzle of the main propulsion system.

The first system consists of a group of boosters, each of which can deliver an impulse of pre-determined intensity and whose duration is either continuous or also predefined. This implies that the vehicle is constantly in rotation around its roll axis, or piloted by a complementary roll system. An alternative solution is that of piloting the booster unit itself in a rolling motion. This necessity is of course a disadvantage. In addition, whatever the arrangement and number of the boosters, the number of corrections possible is limited. The solution consisting of the use of explosive bars has disadvantages and limitations of the same type as those of the boosters mentioned above. In addition, this type of device gives very intense and very brief shock-type impulses, which may not be suitable for all types of vehicle.

Jet switching is in principle discontinuous. The average value of the guiding force is obtained by modulation in time, which implies high switching velocities in comparison with the response time of the vehicle These switching velocities are difficult to achieve mechanically. In addition, a switch is always a source of mechanical excitation of the structure of the vector. Finally, the smallest& number of nozzles enabling pitch, yaw and roll to be obtained simultaneously is six, which is high and implies complexity and weight.

The last system, which consists in orienting the main propulsion jet, uses either one or more control surfaces in the hot gas flow at the diffuser nozzle, or a means of aiming the nozzle or nozzles themselves. The main limitation of this system is that it requires the presence of a main motor in operation during the whole of the guided phase.

The object of the present invention is a guidance system which would enable these disadvantages and limitations to be avoided by using a small number of continuous gas jets (three) which can be oriented about an axis approximately parallel to that of the vehicle, in one embodiment of the invention, and whose deflection can be limited to ±60°.

Figure 2:
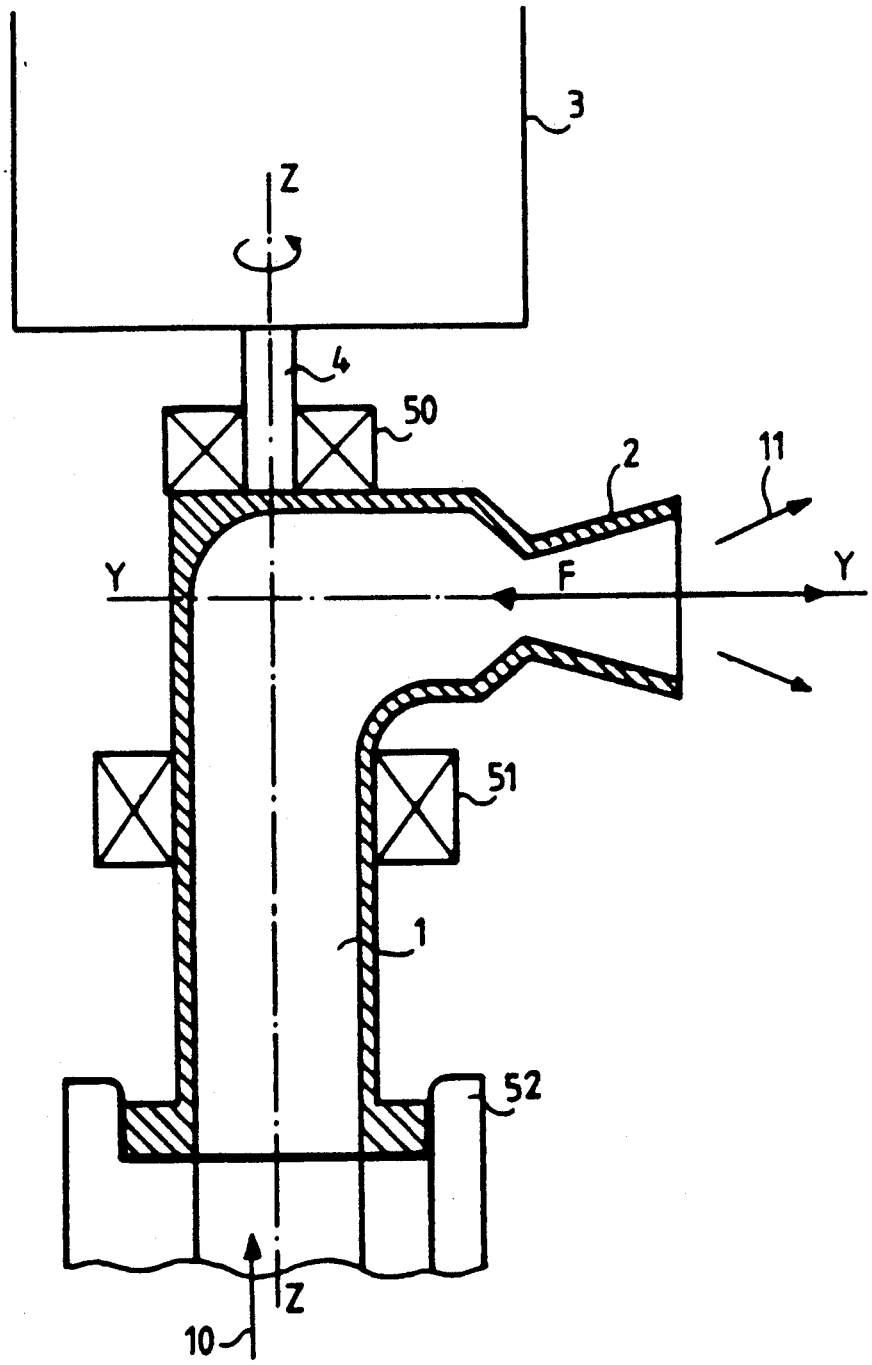

Other objects, characteristics and results of the invention will become evident from the following description, given as a non-restrictive example and illustrated by the appended figures:

FIG. 1, an explanatory diagram of the guidance system according to the invention;

FIG. 2, the diagram of one embodiment of a nozzle used in the guidance system according to the invention.

In these two figures, the same references are used for the same elements.

FIG. 1, then, is an explanatory diagram of the system of guidance according to the invention. In this figure, the external casing V of the vehicle has been represented, seen in transverse (or radial) section i.e. a section which is perpendicular to the longitudinal axis of the vehicle. The casing V is for example in the form of a circle, the longitudinal axis of the vehicle being the centre O of the circle. According to the invention, the vehicle is guided by three and only three directional nozzles, arranged at approximately 120° from each other in the same transverse plane (that of the figure), at the periphery of the vehicle. These nozzles can be oriented around an axis approximately parallel to the longitudinal axis of the vehicle, i.e., supplied from a gas generator, they can provide a continuous gas jet approximately in the plane of the figure, in any direction within predefined limits forming the angle of deflection of the nozzle. The thrust from each of the nozzles results in forces applied on the vehicle, marked $F_1$, $F_2$ and $F_3$. The points where these forces are applied on the casing of the vehicle are market $T_1$, $T_2$ and $T_3$. The force (F1—F3) produced by each of the nozzles makes an angle $\theta_1$, $\theta_2$ and $\theta_3$ with radii. $OT_1$, $OT_2$ and $OT_3$ respectively, this angle being a function of the orientation of the nozzles. These three forces have a resultant $R_F$ which makes an angle $\phi$ with a reference radius OX.

The resultants of these three forces in the planes of pitch, yaw and roll are written as follows:

$$\begin{cases} -\cos\theta_1 + \cos(\pi/3 - \theta_2) + \cos(\pi/3 + \theta_3) = a \cdot \sin\phi \\ \sin\theta_1 + \sin(\pi/3 - \theta_2) - \sin(\pi/3 + \theta_3) = a \cdot \cos\phi \\ \sin\theta_1 + \sin\theta_2 + \sin\theta_3 = b \end{cases}$$

$$\text{where: } a = R_F/F \qquad b = C/R \cdot F \qquad F = F_1 = F_2 = F_3$$

R being the distance of the points where the thrusts from the nozzles are applied to the longitudinal axis of the vehicle, i.e. the radius of the vehicle, and C the roll couple.

Resolution of this system of equations shows that, whatever the value of $\phi$ between 0 and $2\pi$, the resultant force $R_F$ has a value equal to F for a deflection limited to ±60° for each nozzle. It appears therefore that the combined effect of three nozzles enables the pitch, yaw and roll to be controlled simultaneously with the intensity and direction required.

More precisely, it is shown that when the guidance in pitch and yaw is zero, the value of the maximum couple in roll is ±3 FR for a deflection of ±90°. When piloting in roll is zero, the maximum value of the guidance manoeuvring force is about 2.7 F for an angle $\phi$ equal to:

$$\pi/3+2k\pi/3$$

for an angular deflection of the nozzles of ±90°. Finally, this force is about 2F for an angular deflection of the nozzles limited to ±60° and for an angle $\phi$ equal to:

$$\pi/3+2k\pi/3$$

This last case is particularly interesting from a technological point of view because the angle of deflection of the nozzles is limited to ±60°, since an angle which can attain 90° requires certain precautions to be taken so that the jet from the nozzle does not damage the vehicle.

FIG. 2 is a diagrammatic representation of one embodiment of a directional nozzle suitable for use in the system according to the invention.

This figure shows a longitudinal section of a nozzle unit 1 with the diffuser nozzle 2 on the end. The whole can be rotated about its longitudinal axis ZZ with respect to a fixed part 52 using a motor 3, for example an electric motor, via shaft 4. The whole is held between bearings 50 and 51. The axis of rotation ZZ is preferentially positioned as close as possible to the centre of thrust, in order to minimise the parasitic torque resulting from a distance between the centre of thrust and the axis of rotation.

In operation, the gases go through the nozzle block longitudinally (arrow 10) and are ejected by the diffuser nozzle (arrow 11), thus giving rise to the thrust F directed along the axis YY of the diffuser nozzle, i.e., in the figure, normal to the axis ZZ.

It should be noted that the axis of rotation (ZZ) of each nozzle is not necessarily parallel to the longitudinal axis of the vehicle. It can make an angle with the latter of a few degrees, up to 45° for example, in such a way that the nozzles supply a constant thrust component on the axis of the vehicle. This enables, for example, compensation of the aerodynamic drag of the vehicle or the force of gravity.

More generally, the axis YY need not be normal to the axis ZZ, and the nozzle need not be mobile in rotation around its axis ZZ but around a second axis, making an angle with axis ZZ. In every case, the nozzles then supply, in addition to the components used for guidance in a transverse plane, a constant thrust component in the axis of the vehicle.

Furthermore, this system of three nozzles can be arranged in a plane which may or may not contain the centre of gravity.

In addition, the guidance system according to the invention can also be used for a vehicle in auto-rotation (roll). To do this, the group of three nozzles is mounted on a part which can rotate more or less freely with respect to the vehicle, making it possible to control the roll coupling of the system with the vehicle.

The guidance system described above uses three directional nozzles, and has in particular the following advantages:

- simple equipment: this system requires three motors and three nozzle units whose manufacturing tolerances do not have to be tight;
- light weight: the motors used can be small, unlike those for aerodynamic guidance which lead to an increase in weight, bulk and cost;
- continuous guidance: this system avoids the shocks, difficulties of switching time and limited number of corrections of the discontinuous or switched pyrotechnic systems;
- simplicity: the motors ensure continuous orientation of the nozzles; their construction and use poses no particular problems.

What is claimed is:

1. A guidance system using continuous gas jets to control the pitch, yaw, and roll of a vehicle, said guidance system comprising: a gas generator and three nozzles which can be continuously supplied form the gas generator, the nozzles being positioned at substantially 120° in a same plane transverse to a longitudinal axis of the vehicle, said nozzles being located at the periphery of the vehicle, each of the nozzles supplying a thrust and being mobile in rotation about a first axis substantially parallel to said longitudinal axis, the thrust of each of the nozzles being contained substantially within the transverse plane, wherein an angle of deflection of each of the nozzles is contained within a predetermined maximum angle of deflection.

2. A system according to claim 1, wherein each of the nozzles includes a nozzle unit having a second rotation axis and a diffuser nozzle with a third rotation axis, said third axis being substantially normal to the second axis.

3. A system according to claim 2, wherein the centre of thrust of each of the nozzles is substantially on the first axis.

4. A system according to claim 2, wherein the third axes of the three nozzles are contained in the transverse plane.

5. A system according to claim 1, wherein the predetermined maximum angle of deflection of each of the nozzles is approximately ±60°.

* * * * *